United States Patent [19]

Rietman

[11] 4,369,861

[45] Jan. 25, 1983

[54] MULTIPLE SECTION MAST WITH A PAIR OF LIFT JACKS BEHIND THE PRIMARY SECTION UPRIGHTS

[75] Inventor: David W. Rietman, Highland, Ind.

[73] Assignee: Allis-Chalmers Corporation, Milwaukee, Wis.

[21] Appl. No.: 205,745

[22] Filed: Nov. 10, 1980

[51] Int. Cl.[3] ..... B66B 9/20

[52] U.S. Cl. ..... 187/9 E; 414/642

[58] Field of Search ..... 187/9 R, 9 E; 414/629, 414/642, 641, 638, 639, 640, 635; 91/189 R

[56] References Cited

U.S. PATENT DOCUMENTS

| | | | |
|---|---|---|---|
| 2,421,472 | 6/1947 | Way | 414/629 |
| 2,456,320 | 12/1948 | Repke | 414/642 |
| 2,581,791 | 1/1952 | Gilman | 187/9 R |
| 3,394,778 | 7/1968 | Brinton | 187/9 E |
| 3,529,739 | 9/1970 | Shaffer | 414/641 |
| 4,030,568 | 6/1977 | Heinold | 187/9 R |
| 4,191,092 | 3/1980 | Farmer | 91/189 R |
| 4,191,276 | 3/1980 | Farmer et al. | 187/9 E |
| 4,219,302 | 8/1980 | Leskovec | 414/635 |
| 4,280,592 | 7/1981 | Bartow | 187/9 E |

OTHER PUBLICATIONS

"Telescoping Cylinder Stages Extend, Retract Simultaneously, at Constant Speed", Esser and Seshasal, *Hydraulics & Pneumatics Magazine,* pp. 144–145, Oct. 1979.

"A Trend in Lift Trucks", *Modern Material Handling Magazine,* pp. 78–81, Apr. 1980.

*Primary Examiner*—Joseph J. Rolla
*Assistant Examiner*—Kenneth Noland
*Attorney, Agent, or Firm*—Charles L. Schwab

[57] ABSTRACT

A pair of three-element, constant speed lift jacks are positioned at the rear of the stationary mast section uprights above the tilt jack connections with the same uprights, thus permitting the mast to be close-coupled to the front of a counterbalanced lift truck. The support for the lower ends of the lift jacks, at the rear of the primary uprights, are reinforced by the pivot brackets for the tilt jacks and also by an intermediate cross tie between the primary uprights.

1 Claim, 5 Drawing Figures

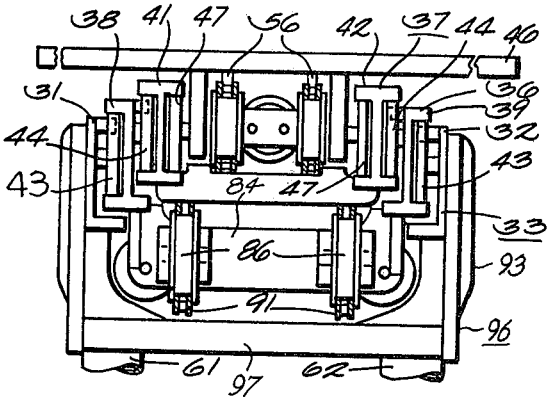
FIG. 3
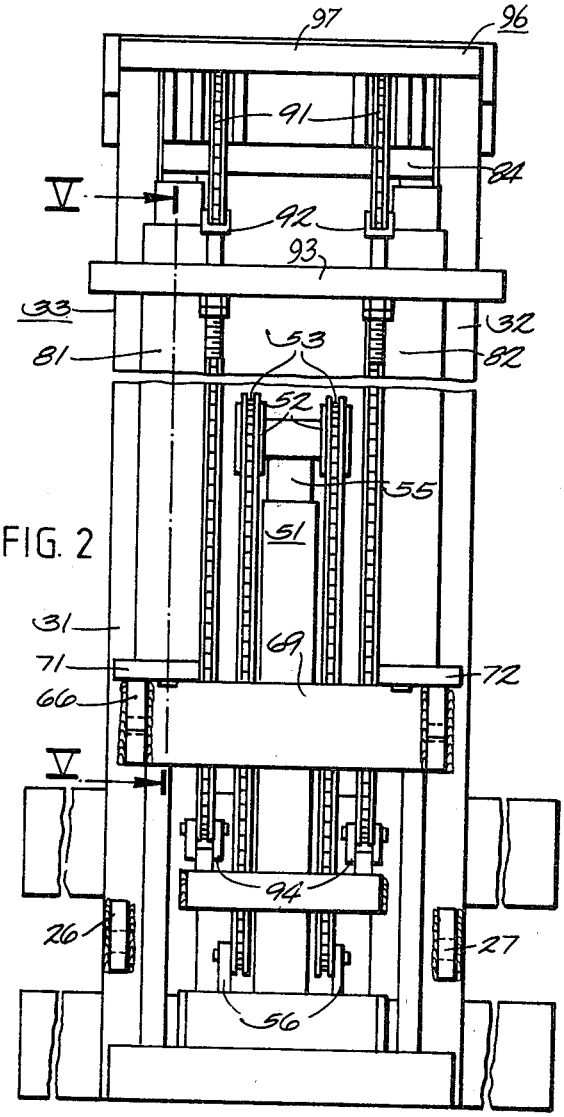
FIG. 2
FIG. 4
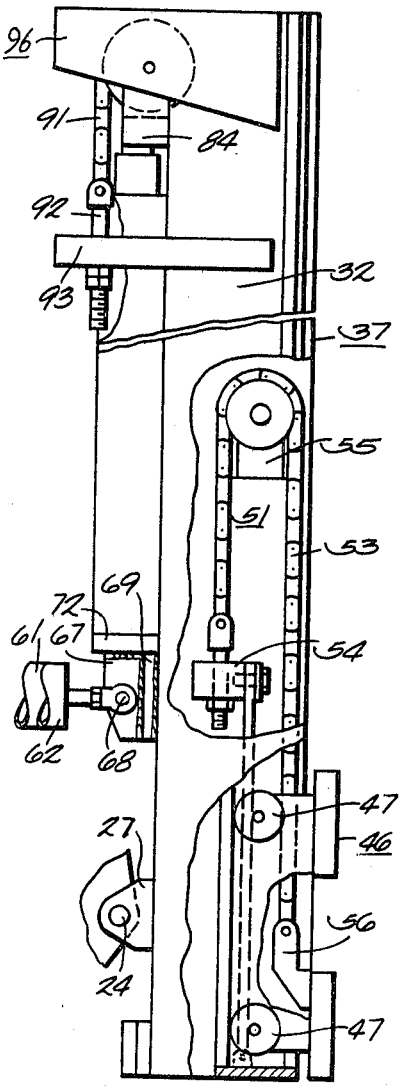

MULTIPLE SECTION MAST WITH A PAIR OF LIFT JACKS BEHIND THE PRIMARY SECTION UPRIGHTS

TECHNICAL FIELD

This invention relates to lift trucks and more particularly to a mast construction for a lift truck.

BACKGROUND OF THE PRIOR ART

In a conventional counterbalanced lift truck, the operator sits behind a front mounted mast. In an effort to improve visibility through the mast, others have suggested using a carriage lift ram with a low collapsed height such as illustrated in U.S. Pat. Nos. 3,394,778; 2,581,791; 4,191,092 and 4,191,276. Also in an effort to improve visibility, others have used a pair of lift jacks disposed laterally adjacent to the lift truck mast uprights thus leaving the center of the mast more open than would be the case if the lift jacks were positioned centrally on the mast. Such constructions are shown in U.S. Pat. Nos. 2,456,320 and 4,030,568 and in an article entitled "A Trend in Lift Trucks—the 'See-Through' Mast!" on pages 78–81 of the April 1980 issue of the Modern Material Handling magazine. In the present invention, a pair of three-element lift jacks are disposed behind the uprights of the primary section of the mast and above the connections of the tilt jacks with the primary section uprights. The three-element lift jacks are preferably of uniform speed, such as described in an article entitled "Telescoping Cylinder Stages Extend, Retract Simultaneously, at Constant Speed" on pages 144–148 of the October 1979 issue of the Hydraulics & Pneumatics magazine. In the beforementioned U.S. Pat. Nos. 4,191,092 and 4,191,276, four and three-element lift jacks are disclosed which provide uniform lift speeds.

BRIEF DESCRIPTION OF THE INVENTION

The invention is advantageously utilized in a lift truck mast pivotally connected near its lower end to the truck chassis for tilting movement about a horizontal tilt axis by power means such as a pair of hydraulic tilt jacks. The lift truck mast includes at least primary and secondary sections each with two laterally spaced uprights. The secondary section is mounted on the primary section for vertical reciprocating movement thereon. The hydraulic tilt jacks have first corresponding ends pivotally connected to the lift truck chassis and second corresponding ends pivotally connected to the primary section uprights a substantial distance above the mast tilt axis. A pair of constant speed, three-element lift jacks are disposed at the rear of, and have corresponding lower ends supported on, the primary section uprights, respectively. The lower ends of the lift jacks are disposed above the pivot connections between the tilt jacks and the primary section uprights and the corresponding upper ends of the lift jacks are connected in lifting relation to the secondary section.

Placement of the lift jacks behind the primary uprights and above the connections of the tilt jacks to the primary uprights permits close coupling of the mast to the truck. Preferably, the pivot brackets for the tilt jacks additionally function as reinforcing braces for the horizontal pads supporting lift jacks behind the primary uprights. An intermediate cross tie between the primary uprights may also partially support the lift jack support pads.

BRIEF DESCRIPTION OF THE DRAWINGS

One embodiment of the invention is illustrated in the drawings in which:

FIG. 2 is a rear view of the mast of the lift truck shown in FIG. 1;

FIG. 3 is a top view of the mast shown in FIG. 2;

FIG. 4 is a side view of the mast shown in FIG. 2 with parts broken away for illustration purposes.

DETAILED DESCRIPTION OF THE DRAWINGS

Figure 1:
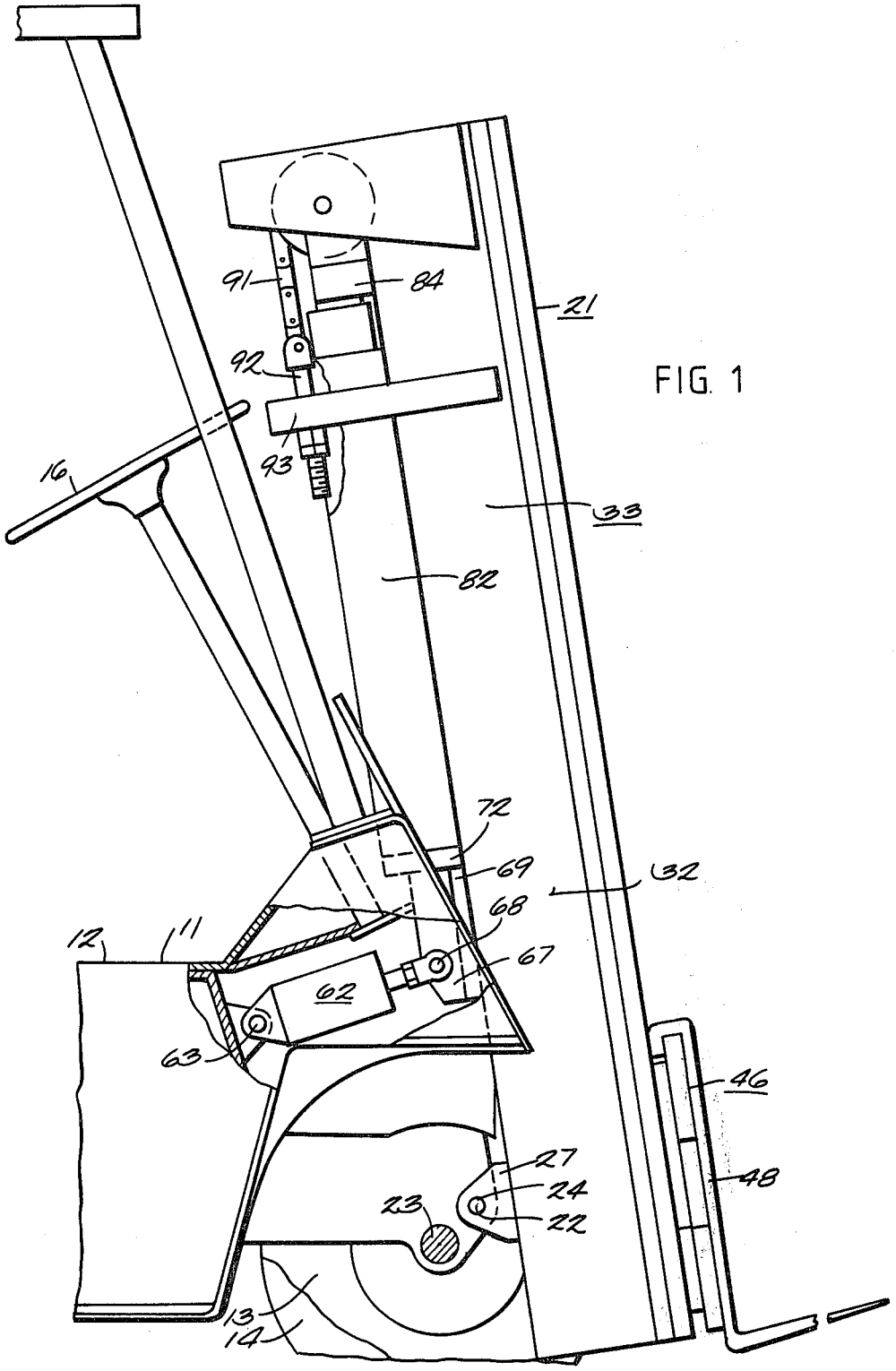
FIG. 1 is a partial side view of a counterbalanced lift truck with parts broken away for illustration purposes.

Referring to FIG. 1, the lift truck 11, in which the present invention is illustrated, includes a chassis 12 supported at its forward end by a pair of power-driven drive wheels 13, 14. The rear wheels, not shown, of the counterbalanced lift truck 11 are steered by the operator through manual operation of a steering wheel 16 at the front of the lift truck. Referring also to FIGS. 2–4, a lift truck mast 21 is pivotally mounted on a horizontal transverse pivot axis 22 disposed above and forward of the transverse pivot axis 23 of the drive wheels 13, 14. The pivot connection between the chassis 12 and the mast is provided by a pair of aligned pivot pins 24, only one of which is shown, which pivotally interconnect a pair of brackets 26, 27 to laterally spaced, vertical walls at the front of the chassis 12. The brackets 26, 27 are secured as by welding to the lower rear of a pair of channel members or uprights 31, 32 of the outer or primary mast section 33.

The mast 21 is a three-section mast having, in addition to the stationary, primary section 33, a secondary section 36 and a tertiary section 37. The secondary section of the mast includes a pair of I-beams or uprights 38, 39 and the tertiary section includes a pair of I-beams or uprights 41, 42. The uprights of the three sections of the mast are in nested relation to one another and include sets of rollers 43 and 44 on the primary and secondary uprights facilitating relative vertical reciprocating movement of the mast sections.

A load-supporting carriage 46 carries a pair of laterally spaced forks 48 and is mounted on the tertiary section uprights 41, 42 by rollers 47. The carriage 46 is vertically reciprocated relative to the inner mast section 37 by a linear single-acting hydraulic lift jack 51 mounted centrally on the inner mast section 37. The upper end of the extensible element 55 of the lift jack 51 supports a pair of pulleys 52 which carry flexible lift members in the form of a pair of lift chains 53. One set of corresponding ends of the lift chains 53 are connected to an intermediate cross tie member 54 secured to the inner mast uprights 41 and 42, and the other set of corresponding ends of the lift chains 53 are connected to brackets 56 on the rear of the carriage.

The mast 21 may be tilted on the lift truck about the transverse tilt axis 22 by a pair of linear double-acting hydraulic tilt jacks 61 disposed in fore and aft relation to the lift truck and in laterally spaced relation to one another. The rear or cylinder ends of the tilt jacks 61, 62 are pivotally connected to the chassis 11 at laterally spaced points thereon by aligned pivot pins 63, only one of which is shown, and the front or rod end of the tilt jack 61, 62 are pivotally connected to vertically extending pivot portions or brackets 66, 67 by a pair of aligned pivot pins 68, only one of which is shown. In the illustrated embodiment of the invention, the pivot brackets 66, 67 are welded to a transverse tie member 69 which in turn is secured as by welding to the rear side of the primary section uprights 31, 32. A pair of cylinder support pads 71, 72 are welded to the rear of the uprights 31, 32, are welded to the transverse tie member 69 and are welded to the tilt cylinder pivot brackets 66, 67. Thus, the tilt cylinder support brackets 66, 67 are reinforcingly secured to horizontal cylinder support pads 71, 72 to provide support or bracket means for supporting a pair of three-element hydraulic lift jacks 81, 82 which bracket means are reinforced by the transverse tie member 69 welded to the rear of the uprights 31, 32 in supporting relation to the pads 71, 72. The linear, single-acting lift jacks 81, 82 have there lower ends supported by the horizontal pads 71, 72 of the bracket means and the upper ends of the three-element constant speed lift jacks 81, 82 are in vertical thrust transmitting relation to a cross tie member 84 secured as by welding to the uprights 38, 39 of the secondary mast section 36. Thus, when the jacks 81, 82 are extended, the secondary section 36 is raised vertically at a constant speed relative to the primary section 33 (assuming constant pressure fluid flow rate to the jacks). A pair of laterally spaced pulleys 86 are journaled on the transverse tie member 84 and carry a pair of flexible lift members in the form of chains 91 which have first corresponding ends 92 fastened to an upper, intermediate cross tie member 93 secured as by welding to the primary uprights 31, 32 and second corresponding ends 94 fastened to a lower, intermediate cross tie 96, secured by welding to the backside of the uprights 41, 42 of the tertiary or inner mast section 37. Thus, when the lift jacks 81, 82 are extended the secondary mast section 36 is raised by virtue of its direct connection with the top of the lift jacks 81, 82 and, through the operation of the lift chains 91 and pulleys 86, the inner tertiary mast section 37 will also be raised relative to the secondary mast section 36. As shown in the drawings, the three-element lift jacks 81, 82 are not connected to the upper, intermediate cross tie 93 which passes to the rear of the lift jacks 81, 82. An upper horizontal cross tie 96 has opposite ends secured, as by welding, to the upper ends of the uprights 31, 32 of the primary section 33 to provide increased strength and rigidity to the primary section. The transverse part 97 of the upper cross tie is spaced rearwardly of the uprights a predetermined distance so as not to interfere with the upward extension of the intermediate and inner elements 102, 103 of the three-element lift jacks 81, 82 or the cross tie.

It will be noted the three-element lift jacks 81, 82 are disposed at the rear of the primary uprights 31, 32, and with their laterally outer edges inboard from the laterally outer edges of the primary uprights 31, 32, so as to minimize interference with the forward vision of the operator.

Figure 5:
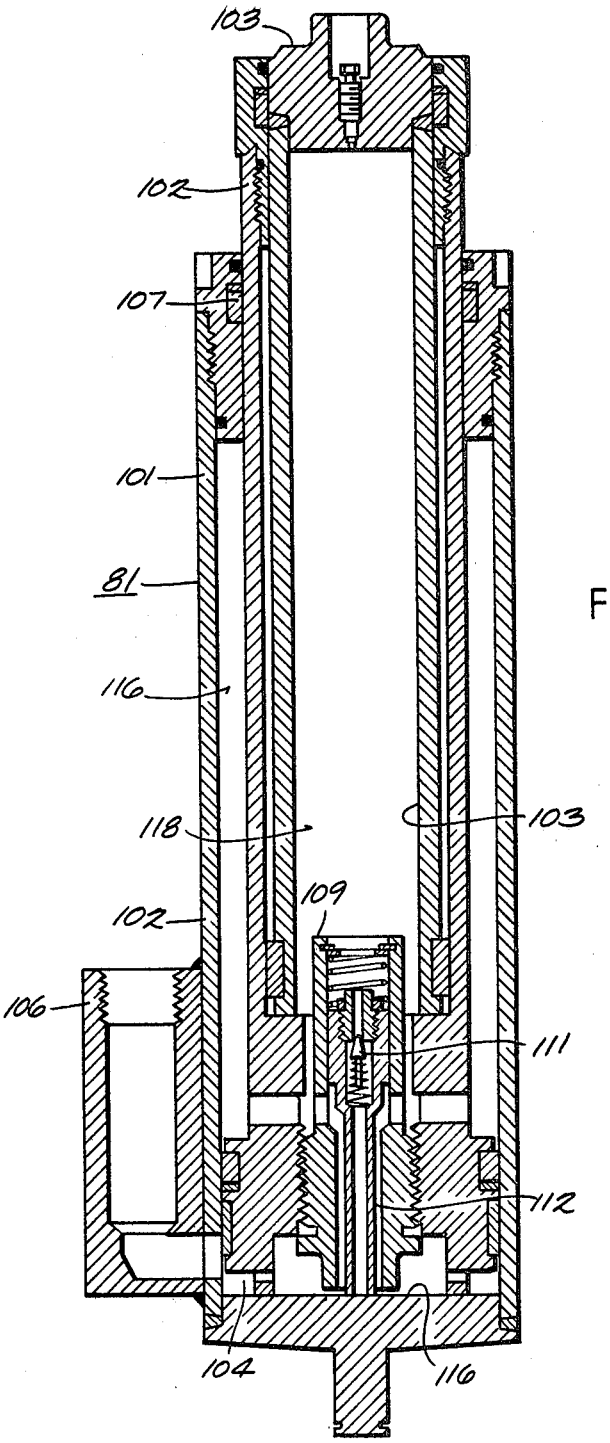
FIG. 5 is a section of a three-element, constant speed lift jack taken along the line V—V in FIG. 2.

Referring to FIG. 5, it will be noted that the three-element lift jack 81 includes three telescopic elements 101, 102, 103. The outer telescopic element or cylinder 101 includes a fluid inlet port 106 for delivery of pressure fluid to a chamber 104 at its lower end and seal means 107 at its upper end in sealing engagement with the intermediate telescopic element 102. The lower end of the intermediate element 102 carries a combined check valve and pressure relief valve assembly 109. a spring-biased relief valve flow control element 111 is located in a spring-biased check valve flow control component 112 and, as shown in FIG. 5, this last mentioned component is held in an open position through its lower end engagement with the interior bottom surface 116 of the outer element or cylinder 101. In this condition, the lower interior end of the outer element or cylinder 101 is in fluid communication with the chamber 116 between the outer and intermediate telescopic elements 101 and 102 and with the interior chamber 118 of the inner telescopic element 103. Upon initial extension of the jack 81, the check valve component 112 will seat, thereby isolating chambers 116 and 118 from the pressure fluid being supplied to the chamber 104. As pressure fluid is delivered to the lower chamber 104, the fluid in the chamber 116 will be exhausted to the chamber 118 to cause extension of inner telescopic element 102. Since the effective cross-sectional area of the chamber 116 is equal to the effective cross-sectional area of the inner telescopic element 103, the latter will be fully extended at the same time the intermediate telescopic element 102 reaches the end of its extension from the outer element 101.

The use of the compact three-element, constant speed lift jacks 81, 82 permits their placement above the tilt jack pivot elements 66, 67. This permits the fore and aft position of the mast to be close to the axis 23 of the drive wheels 13, 14. This close coupling of the mast to the truck optimizes the capacity of the counterbalanced lift truck. The support pads 71, 72, are reinforced by the tilt jack pivot brackets 66, 67 and also by the cross tie 69, thus optimizing use of materials to reduce weight and cost.

The embodiments of the invention in which an exclusive property or privilege is claimed are defined as follows:

1. A lift truck having a mast pivotally connected near its lower end to the truck chassis for tilting movement about a horizontal tilt axis and means for tilting said mast about said tilt axis, characterized by, primary, secondary and tertiary sections each with two laterally spaced uprights, said primary section being pivotally connected at its lower end to said truck chassis, said secondary section being mounted on said primary section for vertical reciprocating movement thereon, said tertiary section being mounted on said secondary section for vertical reciprocating movement thereon, a load carriage supported on said tertiary section for raising and lowering movement relative thereto, said means for tilting said mast including a pair of linear hydraulic tilt jacks having first corresponding end pivotally connected to said chassis and second corresponding ends pivotally connected, respectively, to said uprights of said primary section a substantial distance above said tilt axis, a first horizontal cross tie having its opposite ends secured to said secondary section uprights near their upper ends, a pair of three-element lift jacks having corresponding lower ends of their outer stationary elements supported on the rear of said uprights, respectively, of said primary section above said pivot connections between said tilt jacks and said primary section uprights, the corresponding upper ends of inner elements of said three-element jacks being connected in lifting relation to said first cross tie, an intermediate element and said inner element of each three-element jack being extended from its outer stationary element when said jack is expanded, a second horizontal cross tie having its opposite ends secured to said primary section uprights near the elevation of the top of said outer elements of said lift jacks said second cross tie passing to the rear of said three-element lift jacks without connection thereto, a third horizontal cross tie having its opposite ends secured to the upper ends of said uprights of said primary section, said third cross tie being above said first cross tie when said mast is in its lowered condition, said third cross tie being disposed rearwardly a sufficient distance to permit said intermediate and inner elements of said three-element jacks and said first cross tie to move upwardly without interference with said third cross tie when said three-element jacks are expanded causing said tertiary section to move upwardly relative to said secondary section and said secondary section to move upwardly relative to said primary section thereby achieving full vertical extension of said mast, a pair of pulleys rotatably mounted on horizontal axes on said first cross tie, a pair of flexible members having first corresponding ends connected to said second cross tie, intermediate portions operatively engaging said pulleys, respectively, and second corresponding ends connected to said tertiary section, and a linear hydraulic jack mounted on said tertiary section having an extensible element operatively connected to said carriage and constituting the sole means for raising and lowering said carriage between opposite vertical ends of said tertiary section.

* * * * *